United States Patent [19]

Eshelman

[11] 4,434,765

[45] Mar. 6, 1984

[54] FUEL INJECTION APPARATUS AND SYSTEM

[75] Inventor: Philip V. Eshelman, Troy, Mich.

[73] Assignee: Colt Industries Operating Corp., New York, N.Y.

[21] Appl. No.: 316,899

[22] Filed: Oct. 30, 1981

[51] Int. Cl.[3] ..... F02M 51/02; F02M 51/08

[52] U.S. Cl. ..... 123/472; 239/585; 251/141

[58] Field of Search ..... 123/472, 478, 470; 239/585; 251/129, 141

[56] References Cited

U.S. PATENT DOCUMENTS

| | | | |
|---|---|---|---|
| 3,731,880 | 5/1973 | Williams | 251/141 X |
| 4,264,040 | 4/1981 | Saito | 239/585 |
| 4,292,945 | 10/1981 | Kiesling | 123/440 X |
| 4,351,480 | 9/1982 | Masaki et al. | 239/585 |

*Primary Examiner*—Tony M. Argenbright
*Attorney, Agent, or Firm*—Walter Potoroka, Sr.

[57] ABSTRACT

A fuel metering apparatus is shown as having a throttle body with an induction passage therethrough and a throttle valve for controlling flow through the induction passage, a fuel-air mixture discharge member is situated generally in the induction passage downstream of the throttle valve, an air passage communicates between a source of air and the fuel-air mixture discharge member, the air passage also includes a flow restrictor therein which provides for sonic flow therethrough, and a solenoid type fuel metering valving assembly, having an adjustable movable electrical coil assembly, is effective for metering liquid fuel at a superatmospheric pressure and delivering such metered liquid fuel into the air passage upstream of the flow restrictor thereby causing the thusly metered liquid fuel and air to pass through the sonic flow restrictor before being discharged into the induction passage by the fuel-air mixture discharge member, the fuel-air mixture discharge member has a plurality of discharge ports spaced from each other and directed generally radially inwardly of the induction passage.

41 Claims, 17 Drawing Figures

FUEL INJECTION APPARATUS AND SYSTEM

FIELD OF INVENTION

This invention relates generally to fuel injection systems and more particularly to fuel injection systems and apparatus for metering fuel flow to an associated combustion engine.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of government as being insufficient. Further, such levels of government have also arbitrarily imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, generally, the available technology employable in attempting to attain increases in engine fuel economy is contrary to that technology employable in attempting to meet the governmentally imposed standards on exhaust emissions.

For example, the prior art in attempting to meet the standards for $NO_x$ emissions has employed a system of exhaust gas recirculation whereby at least a portion of the exhaust gas is re-introduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for further burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust which, in turn, requires the supplying of additional oxygen, as by an associated air pump, to such engine exhaust in order to complete the oxidation of the CO and HC prior to its delivery into the atmosphere.

The prior art has also heretofore proposed employing the retarding of the engine ignition timing as a further means for reducing the creation of $NO_x$. Also, lower engine compression ratios have been employed in order to lower the resulting combustion temperature within the engine combustion chamber and thereby reduce the creation of $NO_x$. In this connection the prior art has employed what is generally known as a dual bed catalyst. That is, a chemically reducing first catalyst is situated in the stream of exhaust gases at a location generally nearer the engine while a chemically oxidizing second catalyst is situated in the stream of exhaust gases at a location generally further away from the engine and downstream of the first catalyst. The relatively high concentrations of CO resulting from the overly rich fuel-air mixture are used as the reducing agent for $NO_x$ in the first catalyst while extra air supplied (as by an associated pump) to the stream of exhaust gases, at a location generally between the two catalysts, serves as the oxidizing agent in the second catalyst. Such systems have been found to have various objections in that, for example, they are comparatively very costly requiring additional conduitry, air pump means and an extra catalyst bed. Further, in such systems, there is a tendency to form ammonia which, in turn, may or may not be reconverted to $NO_x$ in the oxidizing catalyst bed.

The prior art has also proposed the use of fuel metering injection means for eliminating the usually employed carbureting apparatus and, under superatmospheric pressure, injecting the fuel through individual nozzles directly into the respective cylinders of a piston type internal combustion engine. Such fuel injection systems, besides being costly, have not proven to be generally successful in that the system is required to provide metered fuel flow over a very wide range of metered fuel flows. Generally, those prior art injection systems which are very accurate at one end of the required range of metered fuel flows, are relatively inaccurate at the opposite end of that same range of metered fuel flows. Also, those prior art injection systems which are made to be accurate in the mid-portion of the required range of metered fuel flows are usually relatively inaccurate at both ends of that same range. The use of feedback means for altering the metering characteristics of such prior art fuel injection systems has not solved the problem of inaccurate metering because the problem usually is intertwined within such factors as: effective aperture area of the injector nozzle; comparative movement required by the associated nozzle pintle or valving member; inertia of the nozzle valving member; and nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits.

The prior art, in view of such anticipated requirements, with respect to $NO_x$, has suggested the employment of a "three-way" catalyst, in a single bed, within the stream of exhaust gases as a means of attaining such anticipated exhaust emission limits. Generally, a "three-way" catalyst is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel) the $NO_x$ will be reduced effectively but the oxidation of CO will be incomplete; if the fuel metering is too lean, the CO will be effectively oxidized but the reduction of $NO_x$ will be incomplete. Obviously, in order to make such a "three-way" catalyst system operative, it is necessary to have very accurate control over the fuel metering function of the associated fuel metering supply means feeding the engine. As hereinbefore described, the prior art has suggested the use of fuel injection means, employing respective nozzles for each engine combustion chamber, with associated feedback means (responsive to selected indicia of engine operating conditions and parameters) intended to continuously alter or modify the metering characteristics of the fuel injection means. However, as also hereinbefore indicated, such fuel injection systems have not proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedback means can never provide the degree of accuracy required in the metering of fuel to an associated engine as to assure meeting, for example, the said anticipated exhaust emission standards.

It has also heretofore been proposed to employ fuel injection type metering means wherein such metering means comprises solenoid valving means and more particularly valving means carried by the solenoid armature. Although this general type of metering means has proven to be effective in its metering function, the cost of producing such solenoid valving means has been generally prohibitive.

Further, various prior art structures have experienced problems in being able to supply metered fuel, at either a proper rate or in a proper manner, as to provide for a smooth engine and/or vehicle acceleration when such is demanded.

Accordingly, the invention as disclosed and described is directed, primarily to the solution of such and other related and attendant problems of the prior art.

SUMMARY OF THE INVENTION

According to the invention, a fuel metering apparatus and system employs a throttle body with induction passage means therethrough and a throttle valve for controlling flow through the induction passage means, fuel metering means for supplying metered fuel, said metered fuel under superatmospheric pressure being supplied to a sonic nozzle-like structure which, in turn, delivers the metered fuel as to annular discharge orifice means situated within the induction passage means downstream of the throttle valve, air is also supplied to the metered fuel upstream of the sonic nozzle-like structure as to at idle engine speed and at least most subsequent engine speeds flow sonically therethrough, the annular discharge orifice means comprises a plurality of discharge ports spaced from each other and directed generally radially inwardly of the induction passage means, the fuel metering means comprising a solenoid valving assembly having a selectively positionable electrical coil assembly within the overall solenoid valving assembly.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted.

DETAILED DESCRIPTION OF THE PREFERRED EMBODIMENT

Figure 1:
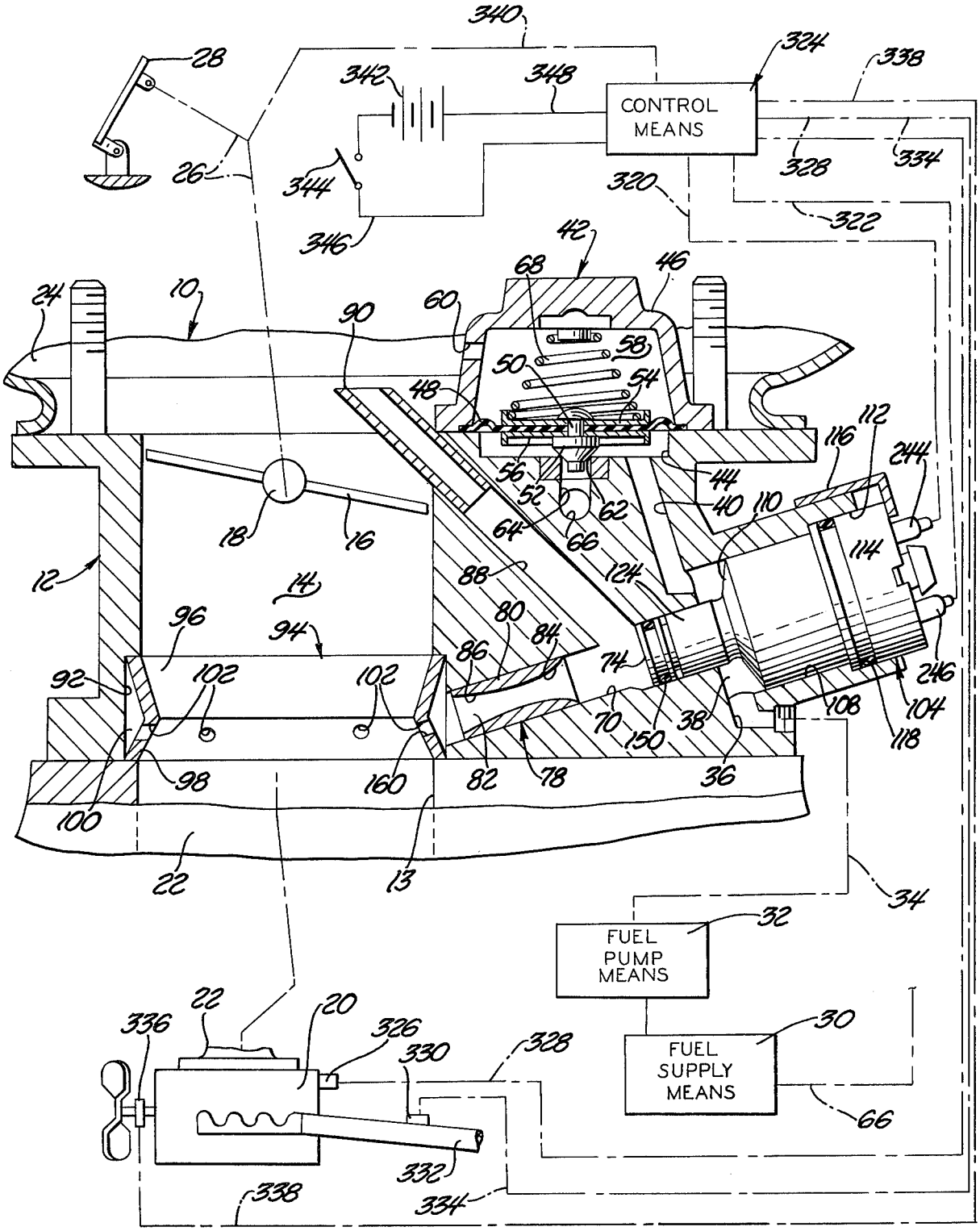
FIG. 1 illustrates, mostly in cross-section, a fuel injection apparatus and system employing teachings of the invention.

Referring now in greater detail to the drawings, FIG. 1 illustrates fuel injection apparatus 10 and system comprised as of induction body or housing means 12 having induction passage means 14 wherein a throttle valve 16 is situated and carried as by a rotatable throttle shaft 18 for rotation therewith thereby variably restricting the flow of air through the induction passage means 14 and into the engine 20 as via associated engine intake manifold means 22. If desired suitable air cleaner means may be provided as to generally encompass the inlet of induction passage means 14 as generally fragmentarily depicted at 24. The throttle valve means 16 may be suitably operatively connected as through related linkage and motion transmitting means 26 to the operator positioned throttle control means which, as generally depicted, may be the operator foot-operated throttle pedal or lever 28 as usually provided in automotive vehicles.

A source of fuel as, for example, a vehicular gasoline tank 30, supplies fuel to associated fuel pumping means 32 which, in turn, delivers unmetered fuel as via conduit means 34 to conduit means 36 leading as to a chamber portion 38 which, in turn, communicates with passage or conduit means 40 leading to pressure regulator means 42. As generally depicted, the pressure regulator means 42 may comprise a recess or chamber like portion 44 formed in body 12 and a cup-like cover member 46. A deflectable diaphragm 48, operatively secured as to the stem portion 50 of a valving member 52 as through opposed diaphragm backing plates 54 and 56, is generally peripherally contained and retained between cooperating portions of body 12 and cover 46 as to thereby define variable and distinct chambers 44 and 58 with chamber 58 being vented as to a source of ambient atmospheric pressure as through vent or passage means 60. A valve seat or orifice member 62 cooperates with valving member 52 for controllably allowing flow of fuel therebetween and into passage means 64 and fuel return conduit means 66 which, as depicted, preferably returns the excess fuel to the fuel supply means 30. Spring means 68 situated as within chamber means 58 operatively engages diaphragm means 48 and resiliently urges valving member 52 closed against valve seat 62.

Generally, unmetered fuel may be provided to conduit means 36 and chamber 38 at a pressure of, for example, slightly in excess of 10.0 p.s.i. Passage 40 communicates such pressure to chamber 44 where acts against diaphragm 48 and spring means 68 which are selected as to open valving member 52 in order to thereby vent some of the fuel and pressure as to maintain an unmetered fuel pressure of 10.0 p.s.i.

Chamber 38 is, at times, placed in communication with metered fuel passage means 70 as through metered fuel orifice means 72 comprising, in the preferred embodiment of the invention, a portion of the overall fuel metering assembly 104 which, in FIG. 1 is shown in elevation and not in cross-section. Passage means 70 may also contain therein venturi means 78 which may take the form of an insert like member having a body 80 with a venturi passage 82 formed therethrough as to have a converging inlet or upstream surface portion 84 leading to a venturi throat from which a diffuser surface portion 86 extends downstream. A conduit 88 having one end 90 communicating as with a source of ambient atmosphere has its other end communicating with metered fuel passage means 70 as at a point or area upstream of venturi restriction means 78 and, generally, downstream of metered fuel passage means 72.

A counterbore or annular recess 92 in body means 12 closely receives therein an annular or ring-like member 94 which, preferably, has an upper or upstream annular body portion 96 which converges and a lower or downstream annular body portion 98 which diverges. The coacting converging and diverging wall portions of annular member 94, in turn, cooperate with recess 92 to define therebetween an annulus or annular space 100 which communicates with metered fuel passage means 70 and the downstream or outlet end of restriction means 78. Preferably a plurality of discharge orifice means 102 are formed, in angularly spaced relationship, in annular member 94 as to be generally circumferentially thereabout. Further, preferably, such discharge orifice means are formed in the downstream diverging portion 98 as to be at or below the general area of juncture between upstream and downstream annular portions 96 and 98. Of such discharge orifice means 102, preferably one orifice means, as designated at 160, is formed as to be in general alignment with the discharge axis of restriction means 78.

Passage 72 is formed through a valve seat member 74 preferably operatively carried by an oscillator type valving means or assembly 104. The metering assembly 104 is illustrated in FIG. 1 as being closely received within a bore 108 in body means 12 as to result in face-like portion 110 forming a portion of the wall means defining chamber 38. A counterbore 112, forming an annular shoulder, serves to receive the larger portion of the assembly 104 and a flange portion 114 of the assembly 104 abuts against such shoulder while suitable clamping means 116 serves to hold the assembly 104 against the shoulder of counterbore 112. An annular seal, such as, for example, an O-ring 118 serves to prevent fuel leakage from chamber 38 past the assembly 104.

Referring now also to FIGS. 2–6, the metering valving means 104 is illustrated as comprising a generally tubular outer housing 120 having a lower (as viewed in FIGS. 2 and 4) end wall 122 the outer surface of which defines said face 110. A generally tubular extension 124 is preferably formed integrally with end wall 122 and internally threaded as at 126 in order to threadably engage an externally threaded portion 128 of the valve seat member 74.

Figure 4:
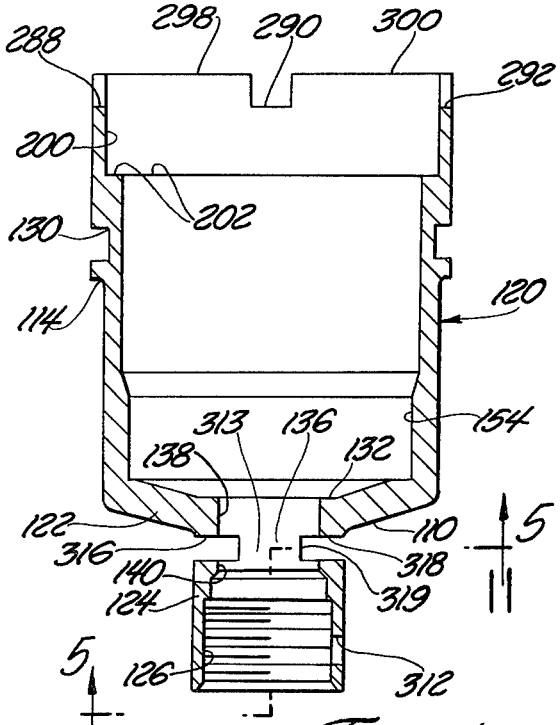
FIG. 4 is an axial cross-sectional view of one of the elements shown in FIG. 2.
Figure 2:
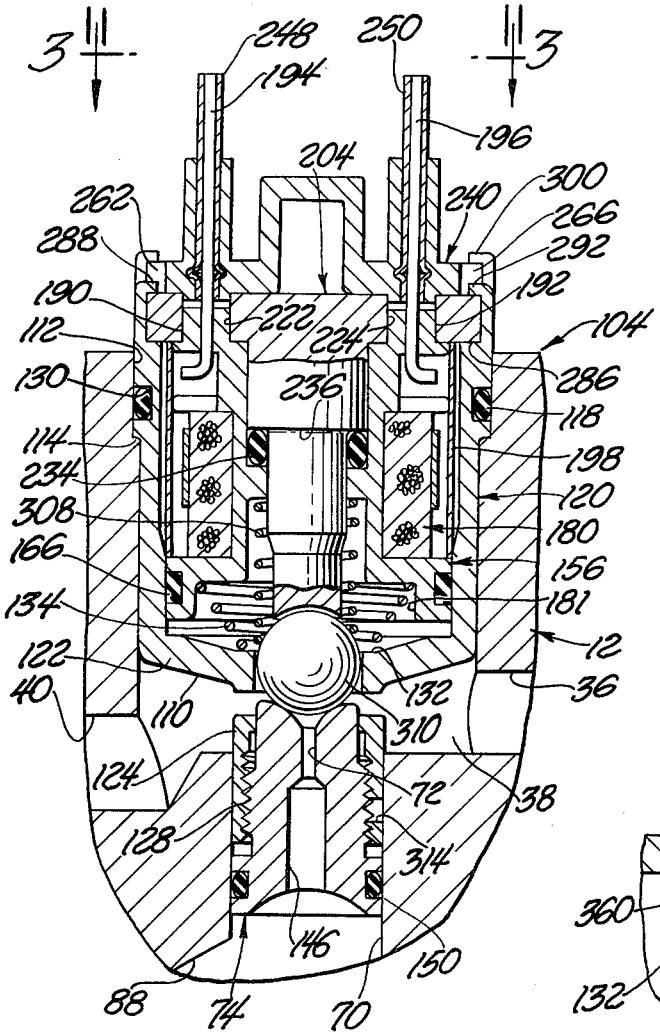
FIG. 2 is a relatively enlarged axial cross-sectional view of the metering valve assembly of FIG. 1.
Figure 5:
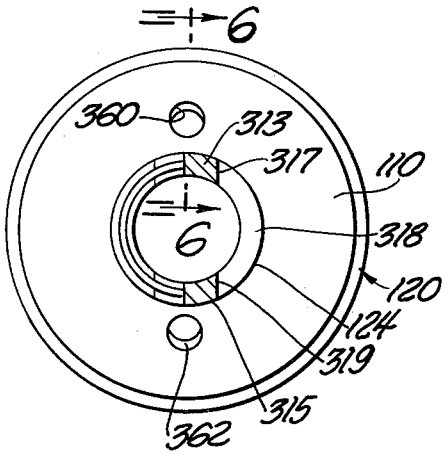
FIG. 5 is a view taken generally on the plane of line 5—5 of FIG. 4 and looking in the direction of the arrows.
Figure 6:
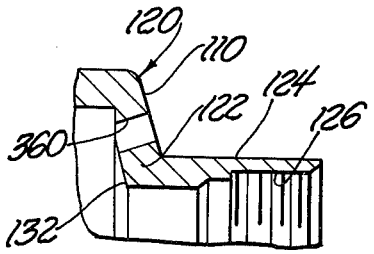
FIG. 6 is a cross-sectional view taken on the plane of line 6—6 of FIG. 5 and looking in the direction of the arrows.

FIG. 4 illustrates the outer housing 120 prior to its assembly with the outer cooperating elements shown in FIG. 2. As can be seen, the housing is provided with a circumferential groove 130 for the reception of annular seal 118. Preferably the inner surface of lower end wall 122 is provided with a flatted portion 132, or the like, in order to serve as a spring seat surface for resilient means 134.

Wall 122 also has a cylindrical passage 136 formed therethrough and such passage may extend through a portion of the extension 124 as to have cylindrical surface 138, in wall 122, and cylindrical surface 140, in extension 124 substantially concentric.

Figure 15:
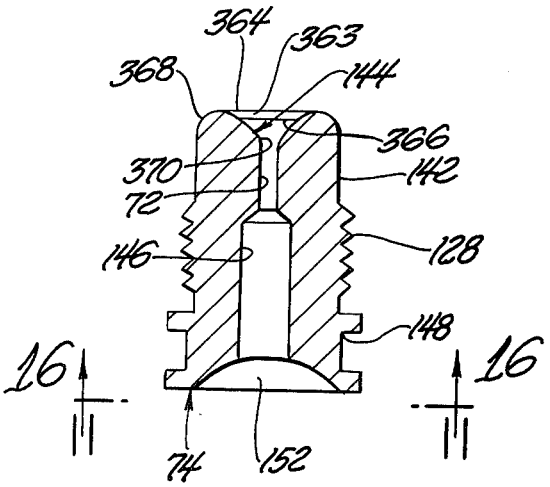
FIG. 15 is an axial cross-sectional view of another element shown in FIG. 2.
Figure 16:
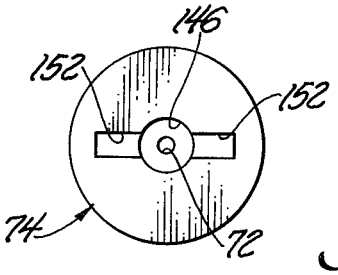
FIG. 16 is a view taken generally on the plane of line 16—16 of FIG. 15 and looking in the direction of the arrows.

As best seen in FIG. 15, the outer diameter 142 of valve seat member 74 is of a size as to be closely received by pilot diameter or surface 140 of extension 124. Further, the valve seating surface 144 is formed as to be substantially concentric with outer diameter surface 142. Passage 72 is shown in communication with a generally enlarged conduit or passage portion 146 which, in turn, as shown in each of FIGS. 1 and 2, communicates metered fuel passage means 70. The lower portion (as viewed in FIGS. 2 and 15) is provided with a circumferential groove 148 which receives suitable sealing means such as, for example, an O-ring 150 so that upon assembly of the overall assembly 104 to the body means 12, such seal 150 prevents any leakage flow from chamber 38 to the metered fuel conduit or passage means 70. The lower-most end of valve seat member 74 is preferably provided with a slot-like recess 152 serving as tool-engaging surface means. The valve seat member 74, at the inlet to passage 72, may be formed to have a straight conical surface portion or band 363 generally between lines 364 and 366 with the radially outer portion of the inlet end being radiused or curved, as at 368, as to enhance flow characteristics in the vicinity of the inlet end. Also, the portion of valve seat member 74 generally between surface portion 363 and passage 72 may be radiused so as to have, for example, such radius 370 tangent to the surface defining passage 72, as generally depicted in FIG. 15.

Referring again, primarily, to FIGS. 2 and 4 the housing 120 is provided with an inner cylindrical surface 154 which is formed to be generally concentric with surface 138. Such surface 154, as shown in FIG. 2, serves to pilot one end of an associated bobbin and electrical coil assembly 156.

Figure 7:
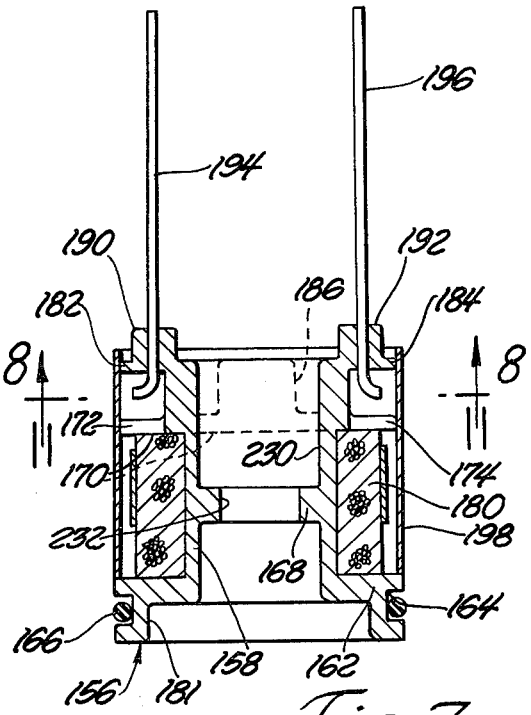
FIG. 7 is an axial cross-sectional view of certain of the elements shown in FIG. 2 and forming a subassembly of the structure of FIG. 2.
Figure 8:
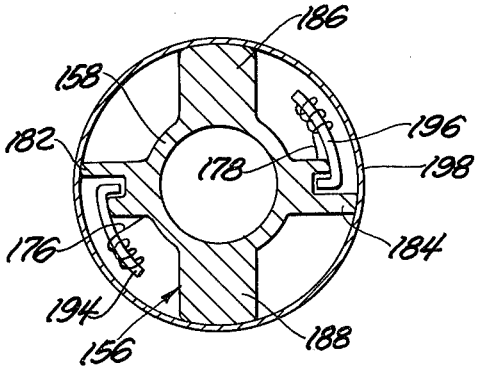
FIG. 8 is a cross-sectional view taken generally on the plane of line 8—8 of FIG. 7 and looking in the direction of the arrows.

Referring now also to FIGS. 7 and 8, the bobbin and coil assembly 156 is illustrated as comprising a generally tubular body portion 158 carrying, at its lower end (as viewed in FIG. 7) an annular flange portion 162 which flange portion, in turn, has a generally circumferential groove 164 for receiving suitable annular sealing means such as, for example, an O-ring 166. Preferably, an integrally formed radially inwardly directed flange-like portion 168 is situated within tubular body portion 158 and situated generally medially thereof.

A second annular flange 170 is also carried by tubular body portion 158 as to be axially spaced from flange portion 162. As will be noted, flange portion 170 is provided with slots 172 and 174 which, respectively, permit the passage therethrough of wire leads or ends 176 and 178 of electrical coil means 180 which is situated externally of and about tubular body portion 158 and axially contained between opposed annular flanges 162 and 170.

Generally axially upwardly (as viewed in FIG. 7) of the annular flange 170, tubular body portion 158 carries integrally formed opposed radiating arms 182 and 184 along with integrally formed opposed radiating arms 186 and 188. The directions of arms 182 and 184, as best seen in FIG. 8, are generally normal to the direction of the arms 186 and 188. Arms 182 and 184 are respectively provided with integrally formed cylindrical extensions or bosses 190 and 192 which respectively receive therethrough electrical terminal members 194 and 196. As shown in FIG. 8, the lower ends of terminal members 194 and 196 are respectively operatively connected to coil ends 176 and 178 as through, for example, soldering. Preferably, an electrically insulating sleeve 198 is placed about the coil means 180 and the connections of terminals 194, 196 and coil ends 176, 178.

Referring again to FIGS. 2 and 4, it can be seen that the outer housing 120 is provided as with a relatively enlarged bore 200 at its upper (as viewed in FIGS. 2 and 4) portion defining an annular shoulder 202 against which (as shown in FIG. 2) a pole piece or core means 204 is abuttingly held.

Figure 10:
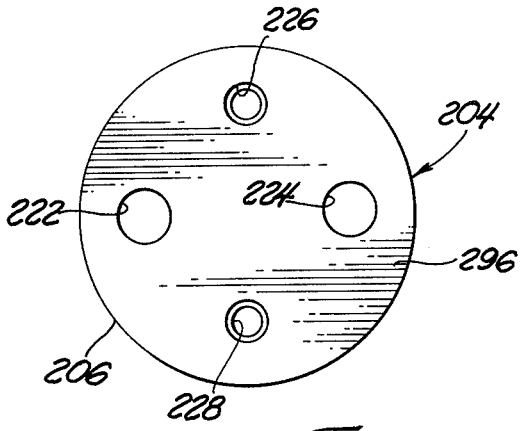
FIG. 10 is a view taken generally on the plane of line 10—10 of FIG. 9 and looking in the direction of the arrows.
Figure 9:
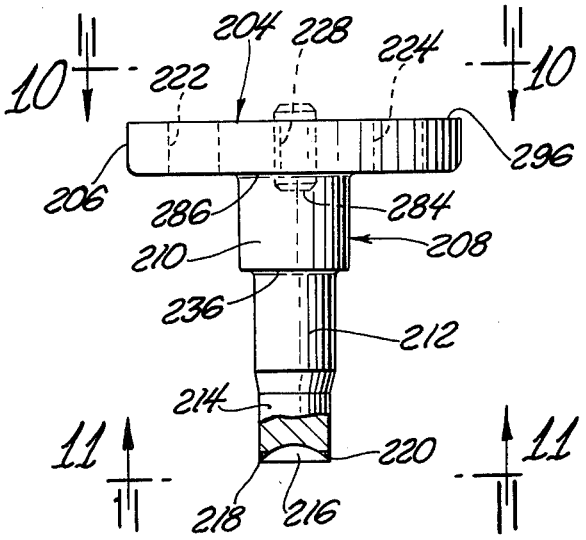
FIG. 9 is an elevational view, with a portion thereof broken away and in cross-section, of one of the elements shown in FIG. 2.
Figure 11:
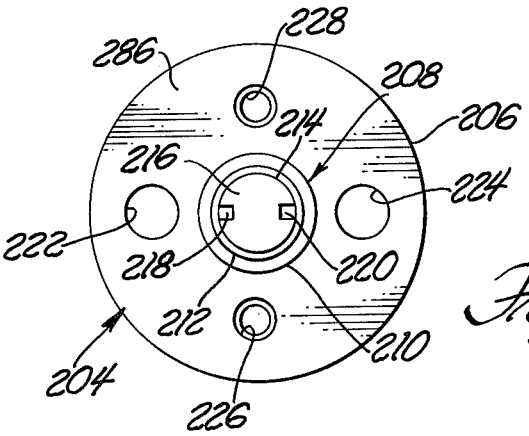
FIG. 11 is a view taken generally on the plane of line 11—11 of FIG. 9 and looking in the direction of the arrows.
Figure 12:
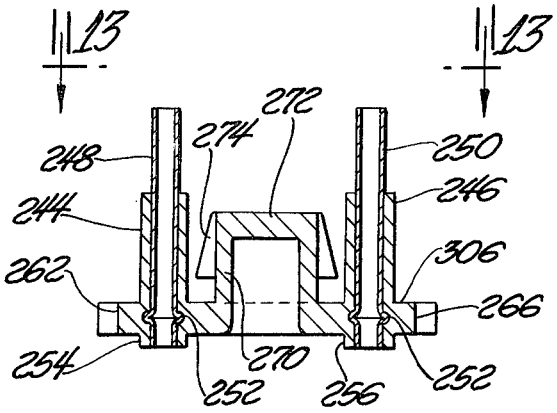
FIG. 12 is an axial cross-sectional view of certain of the elements shown in FIG. 2 and forming a subassembly of the structure of FIG. 2.

Referring now also to FIGS. 9, 10 annd 11, the pole piece or core means 204 is illustrated as comprising a disc-like end body portion 206 having an integrally formed axially projecting generally cylindrical extension 208. The extension portion 208, in turn, is preferably comprised of a relatively largest diameter surface 210 followed by an intermediate diameter surface 212 and, finally, by the smallest diameter surface 214. The axial end of the extension 208 is preferably provided with a spherical surface 216 the center of revolution of which is substantially concentric with the outer diameter of disc body 206 and generally concentric with the cylindrical surfaces 210, 212 and 214. In the preferred embodiment, relief type means are provided in the spherical surface 216. The preferred form of such relief means, as depicted in FIGS. 9 and 11, are generally horizontal radial slots 218 and 220.

The disc body 206 has clearance apertures or passages 222 and 224 formed therethrough which closely but slidably receive therein the bosses 190 and 192, respectively, of the bobbin and coil assembly 156. Further internally threaded holes or passages 226 and 228 are also formed through disc body 206.

Referring, in particular, to FIGS. 2, 7 and 9, it can be seen that the largest cylindrical surface 210 and the intermediate cylindrical surface 212 of pole piece 204 are closely but slidably received, respectively, by the inner cylindrical surfaces 230 and 232 of the tubular body portion 158 and flange 168 of bobbin and coil assembly 156. As will be noted in FIG. 2, suitable sealing means as, for example, an O-ring 234 is situated generally about cylindrical surface 212 as to be axially contained between the upper surface of annular flange 168, of bobbin-coil assembly 156, and the annular shoulder 236 formed by the respective different diameter cylindrical surfaces 210, 212.

Referring to FIGS. 2, 3, 12, 13 and 14, an end cover or terminal retainer assembly 240 is illustrated as comprising a generally disc-like body portion 242 with generally upwardly (as viewed in either FIG. 2 or 12) extending tubular boss-like or shroud-like portions 244 and 246 which, respectively, contain and retain tubular members 248 and 250. The entire assembly 240 is preferably formed by the molding of a dielectric plastic material at which time the tubular members 248 and 250, which may be of metal such as, for example, brass, are molded in place. In order to enhance the retention of members 248 and 250, each of such may be provided with an annular radially outwardly flared portion 252. The underside or innerside of disc body 242 may also be provided with cylindrical boss-like portions 254 and 256 which, upon overall assembly, and as shown in FIG. 2, are closely slidably received within clearancelike passages 222 and 224 of pole piece disc body 206, respectively.

Figure 13:
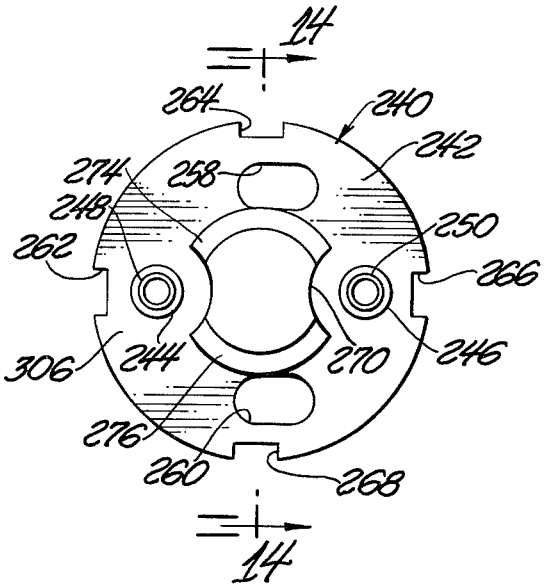
FIG. 13 is a view taken generally on the plane of line 13—13 of FIG. 12 and looking in the direction of the arrows.
Figure 14:
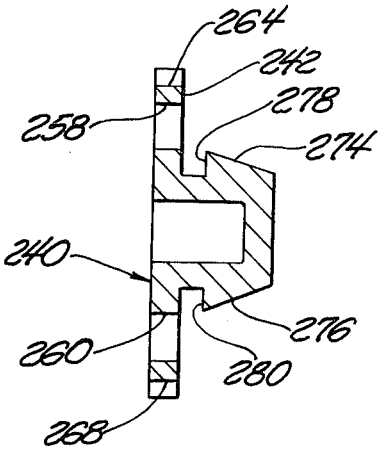
FIG. 14 is a cross-sectional view taken generally on the plane of line 14—14 of FIG. 13 and looking in the direction of the arrows.

As best seen in FIG. 13, the cover disc body 242 has generally elongated clearance apertures or passages 258 and 260 formed therethrough as well as a plurality of notch like radial recesses or clearances 262, 264, 266 and 268 formed generally in the periphery thereof. Further in the preferred embodiment, end cover 240 is formed with a centrally situated generally tubular upstanding portion 270 having a closed end 272 and integrally formed oppositely disposed sloped portions 274 and 276 which terminate, respectively, at 278 and 280 providing a preselected clearance between such terminations and the juxtaposed surface or face of disc body 242. Such clearances enable the use of, for example, a yoke-type clamping bracket for securing the entire assembly 104 to the related body structure 12.

Figure 3:
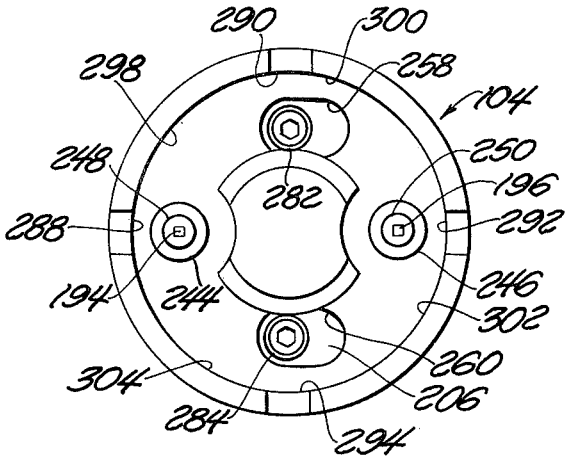
FIG. 3 is a view taken generally on the plane of line 3—3 of FIG. 2 and looking in the direction of the arrows.

The following may be the method and manner of assembling the various details, subassemblies and/or elements (as shown in FIGS. 4, 5, 6, 7, 8, 9, 10, 11, 12, 13, 14, 15 and 16) into the assembly 104 of FIGS. 2 and 3. First, the spring means 134 may be inserted into the housing 120 (FIG. 4), as to have a relative position as depicted in FIG. 2, and then the bobbin-coil assembly 156 (FIGS. 7 and 8) may be inserted into the housing 120 (FIG. 4) as to have a relative position as generally depicted in FIG. 2. The bobbin-coil assembly 156 thusly being inserted also contains the upper end of spring means 134 within the cup-like recess 181 (FIG. 7) formed in the lower end of the bobbin flange portion 162.

Next, allen socket head screws 282 and 284 are respectively threadably engaged with internally threaded passages 226 and 228 of pole piece disc body 206 and therein threadably rotated sufficiently as to extend beyond the face 286 of pole piece disc body 206 a preselected distance as generally typically depicted in phantom line at 284 of FIG. 9.

The O-ring 234 may then be inserted into the tubular body portion 158 of bobbin-coil assembly 156 as to be generally above inner flange 168 (FIG. 7). Spring 308 is positioned over end of pole piece 204.

The pole piece or core means 204 (FIG. 9), with screws 282 and 284, is then assembled into housing 120 (FIG. 4) and aligned so that the cylindrical bosses 190 and 192 are respectively received by coacting clearance passages 222 and 224. At this time the inner projecting ends (projecting beyond face 286 of FIG. 9) of screws 282 and 284, respectively, abuttingly engage arm portions 186 and 188 of the bobbin-coil assembly 156.

Next, the cover or terminal assembly 240 (FIGS. 12, 13 and 14) may be assembled as by passing terminals 194 and 196 through tubular members 248 and 250, respectively, until the underside bosses 254, 256 (FIG. 12) are respectively closely received within clearance apertures 222 and 224 of pole piece disc body 206. The thusly juxtaposed cover assembly 240, pole piece 204 and bobbin-coil assembly 156 may then be moved, in unison, downwardly (as viewed in FIG. 2) until face 286 of pole piece 204 abuts against coacting annular shoulder 202 (FIG. 4). At that time the bobbin-coil assembly 156, pole piece 204 and cover assembly 240 may be rotated about their common axis until the recesses 262, 264, 266 and 268 are in respective radial alignment with notched-out portions 288, 290, 292 and 294 of the housing 120 at which time such notched-out portions are formed over the opposite face 296 of pole piece 204 and the portions 298, 300, 302 and 304 of housing 120, generally between such notched-out portions 288, 290, 292 and 294 are formed over surface 306 of cover disc body portion 242 thereby holding all of such elements in assembled condition.

It should be apparent that as the pole piece 204 and screws 282 and 284 are thusly moved downwardly (until abutting seating is achieved as between pole piece surface 286 and housing shoulder 202, the bobbin-coil assembly 156 is also moved a corresponding amount against the resilient resistance of spring means 134.

Next the armature 310, a sphere which may be a ball bearing, is inserted through extension 124 and passage means 136 (FIG. 4) followed by the valve seat member 74 (FIGS. 1, 14, 15 and 16) which is threadably engaged with the internal threaded portion 126 of extension 124.

Once the various elements are thusly assembled, calibration of the assembly 104 is undertaken. In such calibration, the valve seat member 74 is threadably rotated axially inwardly until the armature 310, pushed against the resilient resistance of spring 308 by the valve seat member 74, becomes seated against the spherical surface 216 of pole piece 204 (the surface 216 being complementary to the spherical surface of armature 310). Following this, the valve seat member 74 is threadably rotated in the opposite direction, causing outward axial movement thereof, until the valve seat member 74 has moved axially outwardly (downwardly as viewed in FIG. 2) a preselected distance as, for example, 0.005 inch. Since spring 308 is constantly resiliently urging armature 310 away from the pole piece face 216, armature 310 will have moved a corresponding distance away from the pole piece face 216 which, in this case, is assumed as being 0.005 inch.

At this time the valve seat member 74 is suitably fixed to the extension 124 as to prevent any further relative threadable rotation of the valve seat member 74. Although various means could be employed for thusly fixing the valve seat member 74, in the preferred embodiment an aperture 312 is formed in the extension 124 as to make visible a portion of the coacting threads 126 and 128 in that area. Such threads are then, as at the side of such aperture 312, welded to each, as by a laser, thereby preventing further relative rotation of valve seat member 74. Such point of laser weld may be represented as at 314 of FIG. 2.

The assembly 104 is then placed into a test stand and the coil 180 pulsed at a preselected frequency and a preselected pulse width while fluid under a preselected pressure (assumed to be, for example, 10.0 p.s.i.) is flowed into ports 316 and 318 of extension 124. At this point it should be made clear that even though ball 310 has heretofore been referred to as an armature, it also functions as a valve member. With every pulsed energization of coil means 180, armature-valve 310 is drawn upwardly (as viewed in FIG. 2) against the pole piece face 216 thereby opening valve seat member 74 passage 72 to flow therethrough. The rate of flow of such pressurized fluid (during the pulsing of the coil means 180) through the inlet port means 316 and 318 and out of passage 146 is measured and if the rate of fluid flow is, for example, less than a preselected magnitude of rate of flow the allen screws 282, 284 (FIG. 3) are adjusted in such a direction as to permit the spring 134 (FIG. 2) to resiliently move the bobbin-coil assembly 156 upwardly (as viewed in FIG. 2) a corresponding distance. Such upward movement of the bobbin-coil assembly 156 functions to correspondingly move upwardly the integrally formed radial flange portion 168 (FIG. 7) which serves as a fixed spring perch for valve-armature spring 308. Such movement lessens the preload of spring 308 and, consequently, has the ultimate effect of increasing the rate of fluid flow through passages 72 and 146 without changing the pulse frequency or duration. Of course, such upward movement of bobbin-coil assembly 156 is continued until the desired rate of fluid flow through passages 72 and 146 is achieved at which time the adjustment screws 282 and 284 are preferably prevented from further unauthorized adjustment.

If, instead, it is found that the rate of fluid flow is, for example, more than a preselected magnitude of rate of flow, the allen screws 282 and 284 (FIG. 3) are adjusted in such a direction as to cause the bobbin-coil assembly 156 to move downwardly (as viewed in FIG. 2) against the resilient resistance of spring means 134 a corresponding distance. Such downward movement of the bobbin-coil assembly 156 functions to correspondingly move downwardly the integrally formed radial flange portion 168 (FIG. 7) which, as already stated, serves as a fixed spring perch for valve-armature spring 308. Such downward movement increases the preload of spring 308 and, consequently, has the ultimate effect of decreasing the rate of fluid flow through passages 72 and 146 without changing the pulse frequency or duration. Of course, such downward movement of bobbin-coil assembly 156 is continued until the desired rate of fluid flow through passages 72 and 146 is achieved at which time the adjustment screws 282 and 284 are preferably prevented from further unauthorized adjustment. It should be noted that as the bobbin-coil assembly 156 is thusly axially adjusted, the terminal members 194 and 196 carried thereby, correspondingly supplied within members 248 and 250, respectively. After such calibration, the metering means 104 may be assembled as to associated induction means 10 as generally depicted in FIG. 1. Terminal means 194 and 196 may be respectively electrically connected as via conductor means 320 and 322 to related control means 324. As should already be apparent, the metering means 104 is of the duty cycle type wherein the winding or coil means 180 is intermittently energized thereby causing, during such energization, valve member 310 to move in a direction away from valve seat member 74. Consequently, the effective flow area of valve orifice or passage 72 can be variably and controllably determined by controlling the frequency and/or duration of the energization of coil means 180.

The control means 324 may comprise, for example, suitable electronic logic type control and power outlet means effective to receive one or more parameter type input signals and in response thereto produce related outputs. For example, engine temperature responsive transducer means 326 may provide a signal via transmission means 328 to control means 324 indicative of the engine temperature; sensor means 330 may sense the relative oxygen content of the engine exhaust gases (as within engine exhaust conduit means 332) and provide a signal indicative thereof via transmission means 334 to control means 324; engine speed responsive transducer means 336 may provide a signal indicative of engine speed via transmission means 338 to control means 324 while engine load, as indicated for example by throttle valve 16 position, may provide a signal as via transmission means 340 to control means 324. A source of electrical potential 342 along with related switch means 344 may be electrically connected as by conductor means 346 and 348 to control means 324.

OPERATION OF INVENTION

Generally, in the embodiment disclosed, fuel under pressure is supplied as by fuel pump means 32 to conduit 36 and chamber 38 (and regulated as to its pressure by regulator means 42) and such fuel is metered through the effective metering area of valve orifice means 72 to conduit portion 70 from where such metered fuel flows through restriction means 78 and into annulus 100 and ultimately through discharge port means 102 and to the engine 20. The rate of metered fuel flow, in the embodiment disclosed, will be dependent upon the relative percentage of time, during an arbitrary cycle time or elapsed time, that the valve member 310 is relatively close to or seated against orifice seat member 74 as compared to the percentage of time that the valve member 310 is relatively far away from the cooperating valve seat member 74.

This is dependent on the output to coil means 180 from control means 324 which, in turn, is dependent on the various parameter signals received by the control means 324. For example, if the oxygen sensor and transducer means 330 senses the need of a further fuel enrichment in the motive fluid being supplied to the engine and transmits a signal reflective thereof to the control means 324, the control means 324, in turn, will require that the metering valve 310 be opened a greater percentage of time as to provide the necessary increased rate of metered fuel flow. Accordingly, it will be understood that given any selected parameters and/or indicia of engine operation and/or ambient conditions, the control means 324 will respond to the signals generated thereby and respond as by providing appropriate energization and de-energization of coil means 180 (causing corresponding movement of valve member 310) thereby achieving the then required metered rate of fuel flow to the engine.

The prior art has employed relatively high pressures both upstream and downstream of the fuel metering means in an attempt to obtain sufficient fuel atomization within the induction passage means. Such have not proven to be successful.

It has been discovered that the invention provides excellent fuel atomization characteristics even when the upstream unmetered fuel pressure is in the order of 10.0 p.s.i. (the prior art often employing upstream unmetered fuel pressures in the order of 40.0 p.s.i.). The invention achieves this by providing a high velocity air stream into which all the metered fuel is injected, mixed and atomized and subsequently delivered to the engine induction passage.

That is, more particularly, in the preferred embodiment, conduit means 88 supplies all of the air needed to sustain idle engine operation when the throttle valve means 16 is closed. As can be seen a flow circuit is described by inlet 90 of conduit 88, conduit 88, passage means 70, passage means 82, annulus 100, orifice means 102 and engine intake manifold induction passage means 13; such, in the preferred embodiment of the invention, provides all of the air flow to the engine 20 required for idle engine operation. The restriction means 78 is of a size as to result in the flow through passage 82 being sonic during idle engine operation. The fuel which is metered by valve member 74 and injected into passage 70 mixes with the air as the metered fuel and air flow into inlet 84 of venturi nozzle-like means 78 and become accelerated to sonic velocity. The fuel within such fuel-air mixtures becomes atomized as it undergoes acceleration to sonic velocity and subsequent expansion in portion 86 of venturi means 78. The atomized fuel-air mixture then passes into annulus 100 and is discharged, generally circumferentially of induction passage means 14, through the discharge port means 102 of diffuser means 94 and into passage means 13 of engine 20. In the preferred embodiment of the invention, the restriction means 78 not only provides for sonic flow therethrough during idle engine operation but also provides for sonic flow therethrough during conditions of engine operation other than idle and, preferably, over at least most of the entire range of engine operation.

When further engine power is required, throttle valve means 16 is opened to an appropriate degree and the various related parameter sensing means create input signals to control means 324 resulting in fuel metering means 104 providing the corresponding increase in the rate of metered fuel to the passage 70 and, as hereinbefore described, ultimately to engine 20.

As should be apparent, suitable temperature responsive means may be provided in order to slightly open throttle valve 16 during cold engine idle operation in order to thereby assist in sustaining such cold engine idle operation and preclude rough engine operation.

Referring to FIG. 1 it can be seen that in the preferred embodiment the diffuser or discharge nozzle means 94 is comprised of a plurality of generally radially extending circumferentially spaced discharge ports or apertures 102 and that preferably at least one, as at 160, of the apertures or ports 102 is situated as to be generally aligned with the path of flow from the sonic nozzle or restrictor means 78. That is, all apertures or discharge ports 102, except for the one identified at 160, are illustrated as having their respective axis generally contained as within a common plane normal to the axis of the induction passage means 14. However, as indicated in FIG. 1 discharge port or aperture 160 is generally aligned with the nozzle 78 axis which, in the preferred embodiment, is inclined (and not normal) to the axis of the induction passage 14.

It has been discovered that good engine and vehicle performance can be obtained even though the spacing as between discharge ports 102 be varied and even though the angle of discharge of such ports 102 (or any one of them) be varied. However, it has also been discovered that generally better engine performance occurs when discharge port or aperture means such as depicted at 160 is provided.

Figure 17:
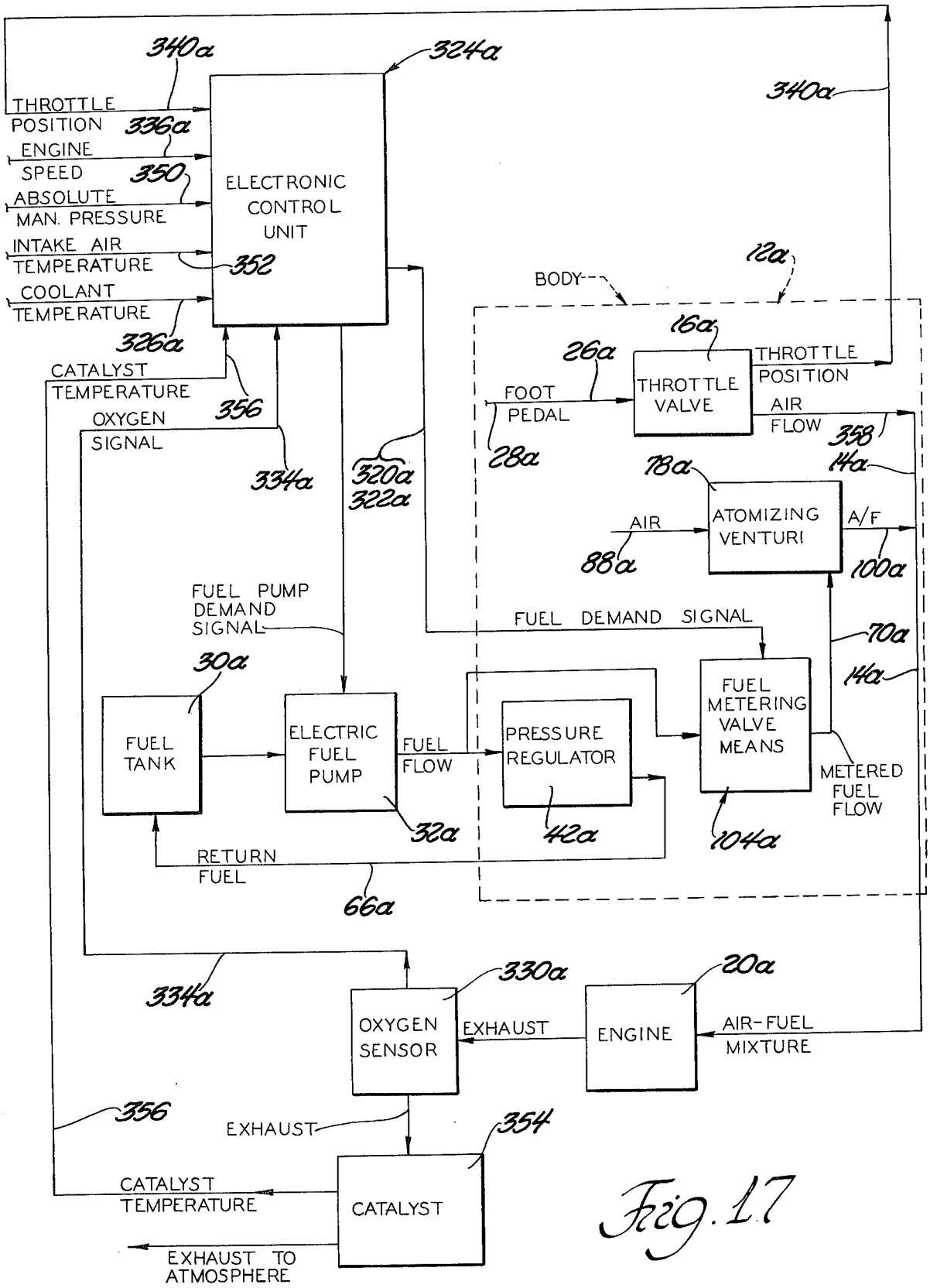
FIG. 17 is a block diagram of an entire fuel metering system as may be applied to or employed in combination with the fuel injection apparatus of FIGS. 1 and 2.

FIG. 17 illustrates in general block diagram the structure of FIG. 1 along with other contemplated operating parameter and indicia sensing means for creating related inputs to the control means which, as generally identified in FIG. 17, may be an electronic control unit. For ease of reference, elements in FIG. 17 which correspond to those of FIG. 1 are identified with like reference numbers provided with a suffix "a".

As generally depicted in FIG. 17 the electronic control or logic means 324*a* is illustrated as receiving input signals, as through suitable transducer means, reflective and indicative of various engine operating parameters and indicia of engine operation. For example, it is contemplated that the electronic logic or control means 324*a* would receive, as inputs, signals of the position of the throttle valve means 16*a* as via transducer or transmission means 340*a;* the magnitude of the engine speeds as by transducer or transmission means 336*a;* the magnitude of the absolute pressure within the engine intake manifold 22 as by transducer or transmission means 350; the temperature of the air at the inlet of the induction system as by transducer or transmission means 352; the magnitude of the engine 20*a* coolant system temperature as via transducer or transmission means 326*a;* the magnitude of the engine exhaust catalyst 354 temperature as by transducer or transmission means 356; and the percentage of oxygen (or other monitored constituents) in the engine exhaust as by transducer or transmission means 334*a.*

In considering FIGS. 1, 2 and 17, it can be seen that the electronic control means 122*a,* upon receiving the various input signals, creates a first output signal as along conductor means 116*a* and 118*a* thereby energizing fuel metering valving means 104*a.* If the operator should open throttle valve means 16*a,* as though pedal 28*a* and linkage or transmission means 26*a,* the new position thereof is conveyed to the control means 324*a* and an additional rate of air flow 358 is permitted into the induction passage means 14*a* as to become commingled with the motive fluid being discharged by the nozzle means 94.

In any event, the fuel-air mixture is introduced into the engine 20*a* (as via intake manifold means 22) and upon being ignited and performing its work is emitted as exhaust. An oxygen or other gas sensor, or the like, 330*a* monitors the engine exhaust gases and in accordance therewith creates an output signal via transducer means 334*a* to indicate whether the exhaust gases are overly rich, in terms of fuel, too lean, in terms of fuel, or exactly the proper ratio. The electronic control means, depending upon the nature of the signal received from the gas sensor 330*a,* produces an output signal as via conductor means 320*a* and 322*a* for either continuing the same duty cycle of fuel metering valve means 104*a* or altering such as to obtain a corrected duty cycle and corresponding altered rate of metered fuel flow. Generally, each of such input signals (varying either singly or collectively) to the electronic control means (except such as will be noted to the contrary) will, in turn, cause the electronic control means 324*a* to produce an appropriate signal to the fuel metering valve assembly 104*a.*

As is also best seen in FIG. 17, in the preferred embodiment, a fuel supply or tank 30*a* supplies fuel to the inlet of a fuel pump 32*a* (which may be electrically driven and actually be physically located within the fuel tank means 30*a*) which supplies unmetered fuel to suitable pressure regulator means 42*a* which is generally in parallel with fuel metering valving assembly 104*a.* Return conduit means 66*a* serves to return excess fuel as to the inlet of pump means 32*a* or, as depicted, to the fuel tank means 30*a.* Fuel, unmetered, at a regulated pressure is delivered via conduit means 36 to the upsteam side of the effective fuel metering orifice as determined by orifice means 72 and coacting valving member 74.

In practicing the invention, it is contemplated that certain fuel metering functions may be or will be performed in an open loop manner as a fuel schedule which, in turn, is a function of one or more input signals to the control means 324*a.* For example, it is contemplated that acceleration fuel could be supplied and metered by the fuel metering valving assembly 104*a* as a function of the position of throttle valve means 16*a* and the rate of change of position of such throttle valve means 16*a* while the engine cranking or starting fuel and cold engine operation fuel metering schedule would be a function of engine temperature, engine speed and intake manifold pressure. Further, it is contemplated that open loop scheduling of metered fuel flow would be or could be employed during catalytic converter warm-up and for maximum engine power as at wide open throttle conditions as well as being employed during and under any other conditions considered necessary or desirable.

It is further contemplated that the metering assembly 104 may be so situated within the related induction structure as to have a substantial portion of the housing 120 in contact with liquid fuel as to thereby employ such fuel to serve as a heat sink. In such a situation, of course, the lower end (as viewed in FIG. 2) of the bobbin-coil assembly 156 would be exposed to such fuel. The fuel could not flow further upwardly because of the seals 166 and 234. Accordingly, it is preferred that passage means 360 and 362 of substantial effective flow area be formed as through end wall portion 122 (FIGS. 5 and 6) so as to enable the free flow of such fuel therethrough. Such a flow path is provided in order to eliminate the possibility of interferring hydraulic pressures and/or pulses being generated in response to the reciprocating or oscillating movement of ball valve 310 and causing, in turn, erratic movement and/or seating of the ball armature-valve 310.

As should be apparent, the invention enables the placement of the armature spring means 308 externally of the pole piece means 204 and yet enables the selective adjustment of the preload of such spring means 308 by virtue of the selectively movable bobbin-coil assembly 156.

Although only a preferred embodiment and selected modifications of the invention have been disclosed and described, it is apparent that other embodiments and modifications of the invention are possible within the scope of the appended claims.

What is claimed is:

1. In combination, a combustion engine, fuel metering apparatus for supplying metered rates of fuel flow to said engine, said fuel metering apparatus comprising body means, induction passage means formed through said body means for supplying motive fluid to said engine, throttle valve means situated in said induction passage means for variably controlling the rate of flow of air through said induction passage means, fuel-air mixture discharge means situated in said induction passage means downstream of said throttle valve means, air passage means communicating between a source of air and said fuel-air mixture discharge means, said air passage means comprising flow restriction means, said flow restriction means being calibrated as to provide for sonic flow therethrough at conditions of idle engine operation, fuel metering means for metering liquid fuel in response to engine demands and indicia of engine operation, said liquid fuel when metered by said fuel metering means being discharged into said air passage means at an area thereof downstream of said source of air and upstream of said flow restriction means, said flow restriction means comprising sonic venturi type restriction means, said fuel metering means for metering liquid fuel comprising a duty-cycle type fuel metering solenoid assembly, said fuel metering solenoid assembly comprising bobbin means, a ball armature means, and a field winding carried by said bobbin means, said bobbin means and said field winding being selectively adjustably positionable with respect to said ball armature means, said field winding being intermittently energizable during metering of said liquid fuel as to cause said ball armature means to move toward and away from a closed position with respect to an associated valve seat member and thereby result in an average rate of flow of fuel past said ball armature means which constitutes the then metered rate of liquid fuel flow, unmetered fuel passage means for supplying unmetered fuel to said fuel metering means upstream of said fuel metering means, pressure regulator means operatively communicating with said unmetered fuel for regulating the pressure thereof to a preselected superatmospheric magnitude, said fuel-air mixture discharge means comprising generally annular means defining generally annular passage means, said air-passage means in communicating with said fuel-air mixture discharge means communicates with said generally annular passage means, and discharge port means communicating between said generally annular passage means and said induction passage means for directing the flow of the fuel-air mixture within said generally annular passage means to said induction passage means, said discharge port means comprising a plurality of discharge ports spaced from each other and directed generally radially inwardly of said induction passage means.

2. The combination according to claim 1 wherein said sonic venturi restriction means comprises an upstream situated diffuser section, wherein said diffuser section comprises a downstream end, and wherein said downstream end is situated in said air passage means at a location as not to extend into said induction passage means.

3. The combination according to claim 2 wherein said at least one discharge port is in general alignment with said diffuser section of said flow restriction means.

4. The combination according to claim 1 wherein said annular means defining generally annular passage means comprises a ring-like body member, said ring-like body member comprising radially inner generally annular surface means and radially outer generally annular surface means, said inner surface means comprising relatively upstream situated generally concial converging first surface means and relatively downstream situated generally conical diverging second surface means, said first and second surface means generally cooperating to define a throat-like region, whereby said body means comprises additional surface means defining recess means generally circumscribing said induction passage means and intersecting said air passage means, wherein said ring-like body member is at least partly received within said recess means, and wherein said radially outer generally annular surface means and said additional surface means cooperate to define said annular passage means.

5. The combination according to claim 4 wherein at least one of said plurality of discharge ports is formed through said downstream situated generally conical diverging second surface means.

6. The combination according to claim 4 wherein all of said plurality of discharge ports are formed through said downstream situated generally conical diverging second surface means.

7. The combination according to claim 4 wherein said sonic venturi restriction means comprises an upstream situated diffuser section, wherein said diffuser section comprises a downstream end, and wherein said downstream end is situated in said air passage means at a location as not to extend into said induction passage means.

8. The combination according to claim 7 wherein said at least one discharge port is in general alignment with said diffuser section of said flow restriction means.

9. The combination according to claim 4 wherein said sonic venturi restriction means comprises an upstream situated converging section and a downstream situated diffuser section, wherein said diffuser section comprises a downstream end, and wherein said downstream end is situated in said air passage means at a location as not to extend into said induction passage means.

10. The combination according to claim 9 wherein said at least one discharge port is in general alignment with said diffuser section of said flow restriction means.

11. In combination, a combustion engine, fuel metering apparatus for supplying metered rates of fuel flow to said engine, said fuel metering apparatus comprising body means, induction passage means formed through said body means for supplying motive fluid to said engine, throttle valve means situated in said induction passage means for variably controlling the rate of flow of air through said induction passage means, fuel-air mixture discharge means situated in said induction passage means downstream of said throttle valve means, air passage means communicating between a source of air and said fuel-air mixture discharge means, and fuel metering means for metering liquid fuel under superatmospheric pressure in response to engine demands and indicia of engine operation, said fuel metering means for metering liquid fuel comprising a duty-cycle type fuel metering solenoid assembly, said fuel metering solenoid assembly comprising bobbin means, a ball-armature valve member, and a field winding carried by said bobbin means, said bobbin means and said field winding being selectively adjustably positionable with respect to said ball-armature means, said field winding being intermittently energizable during metering of said liquid fuel as to cause said ball-armature valve to move toward and away from a closed position with respect to an associated valve seat member and thereby result in an average rate of flow of fuel past said ball-armature valve member which constitutes the then metered rate of liquid fuel flow, said liquid fuel when metered by said fuel metering means being discharged into said air passage means at an area thereof downstream of said source of air and upstream of said fuel-air mixture discharge means, said fuel-air mixture discharge means comprising a plurality of discharge ports.

12. The combination of claim 11 wherein said air passage means comprises flow restriction means, and wherein said flow restriction means is calibrated as to provide for sonic flow therethrough for at least certain conditions of engine operation.

13. The combination of claim 12 wherein said flow restriction means comprises venturi type restriction means.

14. The combination of claim 11 wherein said air passage means comprises flow restriction means, and wherein said flow restriction means is calibrated as to provide for sonic flow therethrough during at least idle engine operation.

15. A valving assembly for variably restricting fluid flow, comprising housing means, bobbin means situated in said housing means, said bobbin means comprising a generally medially situated tubular body portion, electrical field coil means carried by said bobbin means, pole-piece means situated generally within said tubular body portion, a valve seat member, fluid flow passage means formed through said valve seat member, said pole-piece means comprising a pole-piece face portion, a valve member situated generally between said face portion and said valve seat member, and resilient means normally resiliently urging said valve member toward operative seating engagement with said valve seat member as to thereby terminate flow through said fluid flow passage means, said bobbin means being selectively adjustably positionable with respect to said pole-piece means.

16. A valving assembly according to claim 15 wherein said pole-piece face portion comprises a spherical configuration.

17. A valving assembly according to claim 15 wherein said valve seat member comprises a valve seating surface, and wherein said seating surface comprises a conical configuration.

18. A valving assembly according to claim 15 wherein said valve seat member is axially adjustable towards and away from said pole-piece face portion.

19. A valving assembly according to claim 15 wherein said pole-piece face portion comprises a spherical configuration, wherein said valve seat member comprises a valve seating surface, wherein said seating surface comprises a conical configuration, and wherein said valve seat member is axially adjustable towards and away from said pole-piece face portion.

20. The combination of claim 11 wherein said fuel metering solenoid assembly further comprises generally cylindrical core means, and wherein said core means comprises an axial end face juxtaposed to said ball-armature valve, and wherein said end face comprises a generally spherical configuration.

21. The combination of claim 11 wherein said fuel metering solenoid assembly further comprises generally cylindrical core means, wherein said core means comprises an axial end face juxtaposed to said valve member and wherein said valve seat member is selectively adjustable generally towards and away from said axial end face.

22. A valving assembly according to claim 15 wherein said resilient means and said bobbin means are operatively connected to each other, and wherein said bobbin means is effective by selective adjustment thereof to increase the magnitude of the preload force of said resilient means upon said valve member.

23. A valving assembly according to claim 15 wherein said resilient means and said bobbin means are operatively connected to each other, and wherein said bobbin means is effective by selective adjustment thereof to decrease the magnitude of the preload force of said resilient means upon said valve member.

24. A valving assembly according to claim 15 wherein said resilient means comprises a coiled compression spring, wherein said spring is situated generally about and externally of said pole-piece means, wherein said spring and said bobbin means are operatively connected to each other, and wherein said bobbin means is effective by selective adjustment thereof to increase the magnitude of the preload force of said spring upon said valve member.

25. A valving assembly according to claim 15 wherein said resilient means comprises a coiled compression spring, wherein said spring is situated generally about and externally of said pole-piece means, wherein said spring and said bobbin means are operatively connected to each other, and wherein said bobbin means is effective by selective adjustment thereof to decrease the magnitude of the preload force of said spring upon said valve member.

26. A valving assembly according to claim 15 wherein said valve member comprises a ball valve also serving as an armature means.

27. A valving assembly according to claim 26 wherein said resilient means and said bobbin means are operatively connected to each other, and wherein said bobbin means is effective by selective adjustment thereof to increase the magnitude of the preload force of said resilient means upon said ball valve.

28. A valving assembly according to claim 26 wherein said resilient means and said bobbin means are operatively connected to each other, and wherein said bobbin means is effective by selective adjustment thereof to decrease the magnitude of the preload force of said resilient means upon said ball valve.

29. A valving assembly according to claim 26 wherein said resilient means comprises a coiled compression spring, wherein said spring is situated generally about and externally of said pole-piece means, wherein said bobbin means are operatively connected to each other, and wherein said bobbin means is effective by selective adjustment thereof to increase the magnitude of the preload force of said spring upon said ball valve.

30. A valving assembly according to claim 26 wherein said resilient means comprises a coiled compression spring, wherein said spring is situated generally about and externally of said pole-piece means, wherein said spring and said bobbin means are operatively connected to each other, and wherein said bobbin means is effective by selective adjustment thereof to decrease the magnitude of the preload force of said spring upon said ball valve.

31. A valving assembly according to claim 30 and further comprising second spring means operatively engaging and resiliently urging said bobbin means in a first direction, and wherein the resilient force of said second spring means upon said bobbin means is decreased when said bobbin means is selectively adjusted to decrease the magnitude of said preload force of the first mentioned spring upon said ball valve.

32. A valving assembly according to claim 29 and further comprising second spring means operatively engaging and resiliently urging said bobbin means in a first direction, and wherein the resilient force of said second spring means upon said bobbin means is increased when said bobbin means is selectively adjusted to increase the magnitude of said preload force of the first mentioned spring upon said ball valve.

33. A valving assembly according to claim 28 and further comprising second spring means operatively engaging and resiliently urging said bobbin means in a first direction, and wherein the resilient force of said second spring means upon said bobbin means is decreased when said bobbin means is selectively adjusted to decrease the magnitude of said preload force of the first mentioned spring upon said ball valve.

34. A valving assembly according to claim 27 and further comprising spring means operatively engaging and resiliently urging said bobbin means in a first direction, and wherein the resilient force of said spring means upon said bobbin means is increased when said bobbin means is selectively adjusted to increase the magnitude of the preload force of said resilient means upon said ball valve.

35. A valving assembly according to claim 25 and further comprising second spring means operatively engaging and resiliently urging said bobbin means in a first direction, and wherein the resilient force of said second spring means upon said bobbin means is decreased when said bobbin means is selectively adjusted to decrease the magnitude of the preload force of the first mentioned spring upon said valve member.

36. A valving assembly according to claim 24 and further comprising second spring means operatively engaging and resiliently urging said bobbin means in a first direction, and wherein the resilient force of said second spring means upon said bobbin means is increased when said bobbin means is selectively adjusted to increase the magnitude of the preload force of the first mentioned spring upon said valve member.

37. A valving assembly according to claim 23 and further comprising spring means operatively engaging and resiliently urging said bobbin means in a first direction, and wherein the resilient force of said spring means upon said bobbin means is decreased when said bobbin means is selectively adjusted to decrease the magnitude of the preload force of said resilient means upon said valve member.

38. A valving assembly according to claim 22 and further comprising spring means operatively engaging and resiliently urging said bobbin means in a first direction, and wherein the resilient force of said spring means upon said bobbin means is increased when said bobbin means is selectively adjusted to increase the magnitude of the preload force of said resilient means upon said valve member.

39. A valving assembly according to claim 15 wherein said bobbin means comprises a generally annular radially inwardly extending flange means, and wherein said resilient means is in operative engagement with said annular flange means.

40. In combination, a combustion engine, fuel metering apparatus for supplying metered rates of fuel flow to said engine, said fuel metering apparatus comprising a body means, induction passage means formed through said body means for supplying motive fluid to said engine, throttle valve means situated in said induction passage means for variably controlling the rate of flow of air through said induction passage means, and fuel metering means for metering liquid fuel under superatmospheric pressure in response to engine demands and indicia of engine operation, said fuel metering means for metering liquid fuel comprising a valving assembly for variably restricting fuel flow, said valving assembly comprising housing means, bobbin means situated in said housing means, said bobbin means comprising a generally medially situated tubular body portion, electrical field coil means carried by said bobbin means, pole-piece means situated generally within said tubular body portion, a valve seat member, fuel flow passage means formed through said valve seat member, said pole-piece means comprising a pole-piece face portion, a valve member situated generally between said face portion and said valve seat member, and resilient means normally resiliently urging said valve member toward operative seating engagement with said valve seat member as to thereby terminate flow through said fuel flow passage means, said bobbin means being selectively adjustably positionable with respect to pole-piece means.

41. A valving assembly for variably restricting fluid flow, comprising housing means, bobbin means situated in said housing means, said bobbin means comprising a generally medially situated tubular body portion, electrical field coil means carried by said bobbin means, pole-piece means situated generally within said tubular body portion, a valve seat member, fluid flow passage means formed through said valve seat member, said pole-piece means comprising a pole-piece face portion, a valve member situated generally between said face portion and said valve seat member, and resilient means normally resiliently urging said valve member toward operative seating engagement with said valve seat member as to thereby terminate flow through said fluid flow passage means, said field coil means being selectively adjustably positionable with respect to said pole-piece means.

* * * * *